United States Patent [19]

LaPointe

[11] Patent Number: 4,791,431

[45] Date of Patent: Dec. 13, 1988

[54] ANTENNA MOUNT FOR VEHICLE

[76] Inventor: Rudolph H. LaPointe, 11917 County Rd., 10-2, Delta, Ohio 43515

[21] Appl. No.: 96,913

[22] Filed: Sep. 14, 1987

[51] Int. Cl.[4] ..... H01Q 1/50

[52] U.S. Cl. ..... 343/906; 343/888; 343/892

[58] Field of Search ..... 343/906, 888, 892; 174/152 A, 153 A; 339/124, 268 S

[56] References Cited

U.S. PATENT DOCUMENTS

| | | | |
|---|---|---|---|
| 2,166,589 | 7/1939 | Harrington | 343/892 |
| 2,200,888 | 5/1940 | Mace | 343/892 |
| 2,300,847 | 11/1942 | Russel | 174/152 A |
| 2,491,713 | 12/1949 | Carington et al. | 343/906 |
| 2,497,687 | 2/1950 | Pickett et al. | 343/888 |
| 2,524,534 | 10/1950 | Morris et al. | 343/888 |
| 2,632,106 | 3/1953 | Carlson | 343/906 |
| 2,668,187 | 2/1954 | Von Wald | 343/906 |
| 3,184,745 | 5/1965 | Betcher | 343/888 |
| 4,184,162 | 1/1980 | Grashow | 343/906 |
| 4,186,401 | 1/1980 | Altmayer | 343/906 |
| 4,200,874 | 4/1980 | Harada | 343/888 |
| 4,611,213 | 9/1986 | Johnson et al. | 343/906 |

*Primary Examiner*—William L. Sikes
*Assistant Examiner*—Robert E. Wise
*Attorney, Agent, or Firm*—Paul F. Stutz

[57] ABSTRACT

This application discloses an improved citizens band radio coaxial antenna mount, featuring a vertical leg for connecting with a whip antenna and a connected internal core extending to near the bottom, and a hollow horizontal leg having exterior connection means for a coaxial connector leading to the radio and said horizontal leg including a central core pin and surrounding compressable spring, serving to control contact of central core elements to complete the connection.

3 Claims, 1 Drawing Sheet

ANTENNA MOUNT FOR VEHICLE

The present invention relates to an antenna mount, and particularly for vehicles, such as automobiles, panel trucks, R.V.'s and the like.

More particularly the present invention relates to a novel antenna mount assembly, for citizen band (CB) radios popularly carried in vehicles, which by reason of its novel construction overcomes problems and defects associated with presently available and conventional antenna mounts presently on the market.

Conventionally, at the present time, the whip-like CB antenna is threaded into available "antenna mounts" having at the top end provisions for threadingly engaging the bottom end of the whip antenna. These available mounts include near the bottom end, means for releaseably engaging a grounded bracket secured to the vehicle and also a connector featuring, an externally threaded boss, threadingly engageable with a conventional solderless coaxial connector featuring an internally threaded cap, which threadingly engages the threaded boss, and at the same time, connecting the core elements.

The signal picked up by the antenna is carried to the radio, where it is translated into an audible message by rubber or vinyl jacketed coaxial cable. Where it is translated into an audible message, similarly, the signal, generated by the radio from the word spoken into the microphone is conveyed to the antenna, for transmission, by the same jacketed coaxial cable. Coaxial cable consists of a central or axial conductor core surrounded by a continuous flexible insulator and it in turn is surrounded by a sheath of braided copper (or other conductor) filaments. This sheath, in turn, is surrounded by a flexible continuous jacket or sleeve of an insulating material, usually a vinyl, rubber or similar material.

To overcome the difficulties of connecting coax through the employment of the usual solder techniques, which is difficult because of the dual construction as just described; there have been developed, so called solderless connectors, one of which is illustrated in FIG. 2 of the drawings. Suffice it to say that the solderless connectors provide a physical, rather than solder contact, which is efficient, secure and preferred to soldering because of the ease and convenience of making connections for various installations. Presently available connection are identified by the number PL-259.

It can be appreciated thus far, the coax cable maintains separate paths, eg. that defined by the core and the other defined by the metalic braid separated from the core by suitable insulator. It is essential for proper transmission and reception to maintain the separate conductor paths, totally separated and themselves individually secure and preferably unblemished by any break or partial break, or for that matter, even a nick in the central core. The presence or existence of any discontinuity or interruption or defect would to the extent thereof detract from, interfere with, and possibly destroy the signal. Similarly, it is imperative that the core conductor and the braid conductor be maintained out of contact, as this would similarly cause or lead to failure.

It can thus be understood and recognized that bending of the coax cable should be avoided if at all possible. Obviously, the sharper the turn or bend accentuated by contact with another element, coupled with vibration will all constitute factors to be avoided if at all possible. Generally, the aforesaid solderless coaxial connectors may be described as of straight through or 180° construction. The construction may be likened to a garden hose connector or coupler at one end of a linear length of garden hose, being connected to another linear section of garden hose. The connection of the coupler is in linear alignment with the hose on either side. Similarly, conventional coax connectors. The aforesaid described conventional antenna mount provides for connection of the upstanding antenna whip while the connector at the bottom is of the 180° or linear type to which is conventionally connected a solderless connector of the type shown in FIG. 2. Understandably, the coax cable extending from the coax connector secured to the bottom of the antenna mount, as above described, must be bent at 90° to proceed laterally through the body of the vehicle, and thence, to the rear mounted matching coax connector on the CB radio. The bending of the coax connector beneath the antenna mount is undesireable because the 90° bend induces a stress both in the outer braided conductor and the inner core and the insulating layers as well. The disadvantage and undesireable character is augmented by the fact that such occurs outside of the vehicle, where the region of bend is exposed to weather conditions including rain, snow, sun, etc., which exert their deleterious effects on the stressed insulation by reason of the right angle bend.

As previously indicated, by reason of all of the foregoing, the cable is short lived and the integrity of either the core or the mesh or woven conductor component is adversely affected, such that the quality of reception and/or transmission deteriorates either resulting in noise, static, poor fidelity, decreased range of reception or transmission or both, and ultimately, total failure.

It is an object of the present invention to provide an antenna mount assembly which obviates, in fact, eliminates the severe right angle bend of coax cable normally necessary in the connection of the coax to the antenna mount.

It is a particular object of the present invention to provide an improved, right angle antenna mount assembly which includes a principal body having a central cavity, a linear core member situated within such cavity and having an upper end and a lower end, means for connecting said upper end with a whip antenna, said central cavity leading to a side opening, a right angle connector member overlying said opening, said latter member having means receiving a conventional coax connector featuring a central pin, and including a central or axial sleeve inclusive of a real rear stem axially moveable in surrounding insulator carried within said right angle connector and a spring means surrounding said stem with spring means being compressable responsive to connection of said conventional coax connector with said right angle connector thereby urging said stem into contact with said lower end of said core.

Several commercial right angle coaxial connectors are known in the art as exemplified by the drawings and specifications included in the following patents:

U.S. Pat. No. 2,335,041/Bruno (11-23-43)
U.S. Pat. No. 4,364,624/Williams (12-21-82)
U.S. Pat. No. 3,530,425/Vachhani (9-22-70)
U.S. Pat. No. 3,836,946/Geiger (9-17-74)
U.S. Pat. No. 3,528,052/Brishka (9-8-70)
U.S. Pat. No. 3,432,798/Brishka (3-11-69)
U.S. Pat. No. 3,047,828/Gregson (7-31-62)
U.S. Pat. No. 2,813,144/Valach (11-12-57)

Unfortunately, the connectors illustrated have been found to be either subject to failure by reason of incomplete or unsatisfactory connection. Others of those illustrated are extremely complicated and subject to malfunction, coupled with extremely high cost, due to the cumbersome and complicated construction.

The foregoing, as well as other objects of the present invention, will become apparent to those skilled in the art from the following detailed description of the right angle, antenna mount, assembly of the present invention, taken in conjunction with the annexed sheet of drawings on which there is presented for purposes of illustration only a single/unitary embodiment of the present invention.

IN THE DRAWINGS

Figure 1:
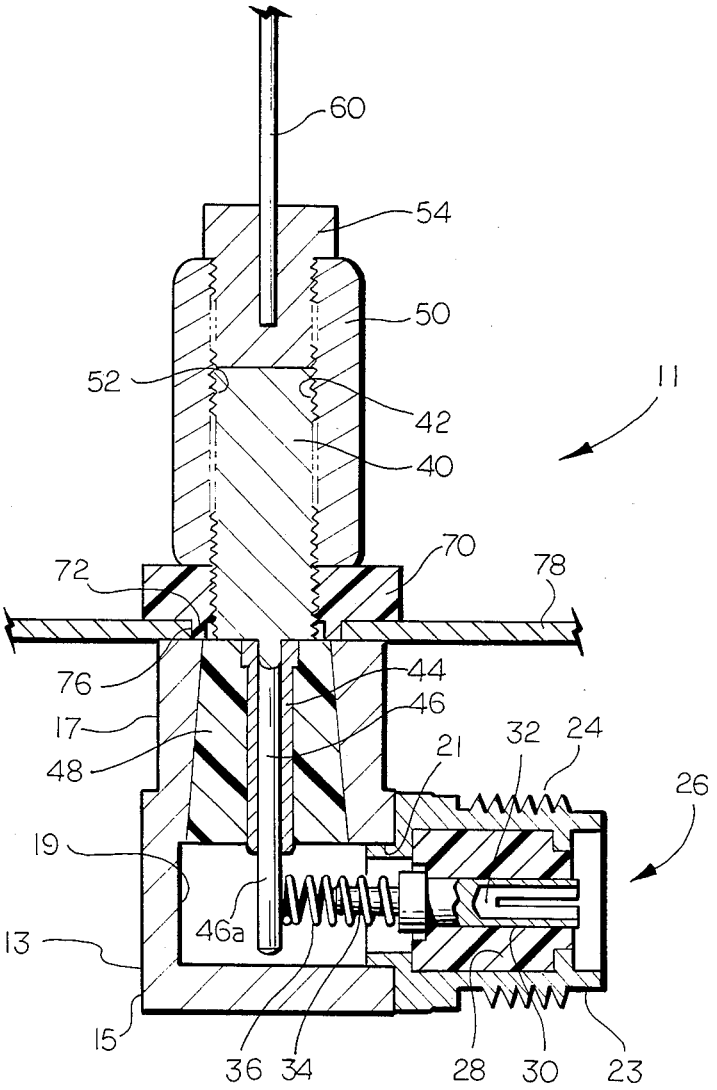
FIG. 1 is a side elevation view (in section) and partially schematic, for the purpose of illustrating details of construction of the improved antenna mount assembly of the present invention.

The antenna mount assembly of the present invention will now be described in more specific detail.

In the drawings, the assembly mount 11 is composed of a principal hollow body 13, composed of a bottom end 15 of cubical configuration, and an upper cylindrical end 17. An inner chamber 19 includes a lateral port opening 21, in which is press fitted a connector assembly 23, having external threads 24 an axial lateral passageway 26 and annular insulator 28. The latter features a central passageway 30, slideably receiving a slotted cylinder 32, having a rearwardly facing stud 34 surrounded by spring 36.

The upper cylindrical end 17 of body 13 contains a core 40 extending beyond cylindrical end 17 and having external threads 42 along the upper region. The core includes a smaller segment 44 within the end 17, and integrally therewith a bottom pin 46 which extends downwardly into the chamber 19. The core at 44 and 46 is surrounded by and held securely by insulator mass 48, in such fashion as to hold the core and the body in fixed mutual relationship. A hexagonal coupling 50 with interior threads 52, threadingly engages the threads 42 of core 40 for vertical movement of the coupling 50. The upper end of the coupling threadingly receives a plug-like base 54 of the whip antenna 60. A polyethylene washer 70 surrounds the core and features a depending annular flange 72 sized to fit within the aperture 76 in mounting bracket plate 78.

Figure 2:
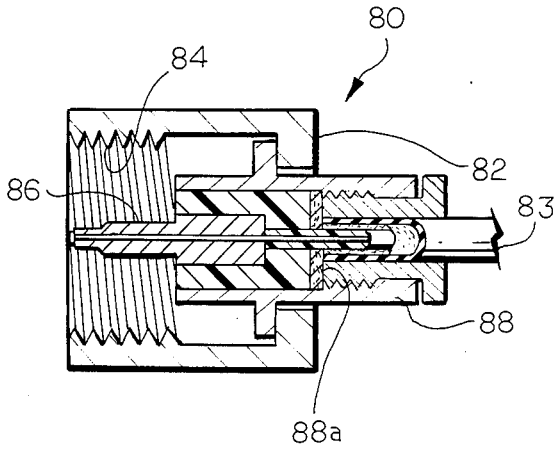
FIG. 2 is a section side view of a typical solderless coax connector.

In FIG. 2 there is disclosed a connector secured to the end of a coax cable 82, cut away as shown but extending laterally for suitable connection to a CB radio. The FIG. 2 connector includes an internally threaded cap 82 whose internal threads 84 are adapted to engage the threads 24 of the connector 23 press fitted into body 13 as shown. As is well known in the art, the assembly of the connector 80, with the terminal end 82 of coax provides for connection of the core element of the coax to the central pin 86 and the braided sheath through adaptor 88 to the shell 82.

To connect the assembly 11 to the bracket as shown, the antenna whip 60 and plug base 54 is removed from the coupling 50. Next, the coupling 50 and the annular insulator of polyethylene is removed and the core is inserted up through the aperture in bracket 78; whereupon the annular insulator 70 is telescoped down over the core 40 and the internally threaded coupling is threaded down to secure the washer 70 into tight engagement with bracket 78 and the annular boss portion 76 of washer fitting in the manner shown. Next, the antenna 60 and plug base 54 can be threaded into the coupler 50.

To connect the radio coax and connector 80, the internal threads 84 of cap 82 are threadingly engaged with the threads 24 of member 23 so that a pin like extension 86 enters the slotted cylinder 32 and as the aforesaid threads are engaged, the slotted cylinder and plug-like rear extension 34 compress the spring to bring the plug-like end 34 into contact with the stem 46 extension of core 40. As can be seen, the lower end of the core 40 identified as segment 44 and pin 46, extends downwardly into the chamber 19 as identified as at **46*a* and in the path of the stud end 34 of slotted cylinder 32; to thereby complete the path, corresponding to the coax core, through the pin 86 of connector 80 to the slotted cylinder 32 to the stud 34, the pin extension 46*a* and intregally the core 40 which through coupling 50 connects with the whip antenna 60**.

The signal path of the outer coax of mesh-like configuration as described above, connects as at **88*a* with plug insert adaptor 88 and thence, to the shell 82, the connector 23 contacting the body portion 15, whose upper end 17 contacts the underside of the bracket 78**, which serves as ground.

It will be appreciated, by reason of the right angle construction of the antenna mount assembly of the present invention, that the coax 82 will not have to be bent, but proceeds laterally through appropriate opening into the interior of the vehicle and thence to the CB radio.

Removal is readily accomplished by simply unscrewing the cap 82 by counter clockwise rotation, which withdraws the pin portion 86 of the connector 80. Simultaneously, the spring 36 in chamber 19 will urge the slotted cylinder to the position as shown in the drawing at FIG. 1, which brings the stud portion 34 automatically out of contact with the end **46*a* of core 40**.

The body portions, the core, the coupling and connector portion 23 are formed of plated brass which is an excellent conductor and pathway for the signal desireably carried from the radio to the antenna in the manner as described and accomplished by the novel constructional features as described herein.

While the assembly mount of the present invention is illustrated in the foregoing drawings and has been described in connection therewith; such represents but a preferred example and embodiment.

Accordingly, modifications, substitutions, and other obvious changes in structure, design and materials may suggest themselves to skilled artists herein and it is intended to include all such modifications, substitutions and obvious changes as being within the spirit and scope of the present invention, unless to do so would violate the language of the appended claims.

I claim:

1. A right-angle, antenna mount assembly adapted for securement to a grounded bracket, said assembly comprising:

(a) a principal, hollow, housing member inclusive of a vertically extending central core insulated from said housing member, said core having an upper end projecting beyond said housing and a lower stud end, said housing member including a lateral side opening, (b) an adjustable coupling threadingly engageable with the upper end of said core, said coupling including means engageable with an antenna, (c) an annular insulator positioned to preclude contact of said coupling with said housing member and said bracket, and (d) a coax connector surrounding said lateral side opening, including an axially reciprocable, linear stem having a sleeve end and a pin end, but separated from said connector by surrounding insulator material, and a spring means surrounding said pin end normally urging said pin end away from said lower core stud but allowing contact when matching coax connector, having a central peg and connected with coax leading to a radio, threadingly engages said coax urging said peg into said sleeve, compressing said spring and urging said pin end into contact with said lower core stud end.

2. A right-angle, antenna mount assembly, adapted for securement to a grounded bracket having a central aperture, and connected to a vehicle, said assembly comprising:

(a) a principal metal, hollow housing member including a vertically upstanding portion surrounding a vertical passageway and including a lateral side opening;

(b) a metal core centrally and securely held in said passageway by surrounding insulator material, said core extending above said housing for connection with said antenna and including an integral lower stud end proximate said lateral side opening;

(c) an annular washer of insulating material precluding contact between said metal core and the grounded bracket;

(d) a hollow coax connector situated about said lateral side opening in said principal housing member, said coax connector including an axial passageway, an annular insulator within said passageway and defining a second axial passageway and a slotted cylinder member mounted for reciprocal axial movement within said second passageway, said cylinder including an axial rear pin end, and a surrounding elongate spring, normally precluding contact of said lateral pin end and said lower core stud end, said coax coupler adapted for engagement with conventional coax connector having a central peg receiveable in said slotted cylinder responsive to threaded engagement of said standard coax connector to thereby compress said spring permitting contact between said rear pin end and said lower core stud end.

3. A citizens-band antenna mount featuring a vertical leg, lateral/horizontal leg terminating in a coaxial connector/fitment for engagement a matching coaxial connector secured to the terminal end of the coax cable leading to a transmittor/receiver of a citizens band radio; said mount comprising;

(a) a principal, generally hollow, housing formed of metallic material defining a first elongate chamber having a side port opening;

(b) an elongated metal core, located centrally within said chamber and separated by a suitable nonconductor, said core having a threaded extremity extending upwardly beyond said housing and lower stem extremity generally intersected by the central axis of said side port opening;

(c) an elongated, tubular conductor member threadingly engaging said threaded extremity of said core;

(d) an annular washer-like insulator surrounding said core and situate between said tubular member and said housing;

(e) a hollow, side member overlying said side port opening and an opposite end threaded for engagement with a conventional coaxial fitment;

(f) an insulator bushing having a central bore, situated within said side member;

(g) a moveable sleeve, adapted to receive the pin of a male, coaxial fitment, slidingly located within said central bore, and having a rear pin end;

(h) a spring, normally urging said sleeve away from said lower stem extremity of said elongated core, capable of compressingly allowing said sleeve pin end to contact said lower stem extremity of said elongated metal core, as a male connector/fitment engages said threaded end of said hollow conduit member.

* * * * *